US009204681B2

(12) United States Patent
Norwood et al.

(10) Patent No.: US 9,204,681 B2
(45) Date of Patent: Dec. 8, 2015

(54) HYBRID BOOTS

(71) Applicant: Ariat International, Inc., Union City, CA (US)

(72) Inventors: John Hollin Kelse Norwood, Oakland, CA (US); Marco Aurelio Grott, Pleasanton, CA (US); Austin C. F. Condit, Solvang, CA (US)

(73) Assignee: Ariat International, Inc., Union City, CA (US)

( * ) Notice: Subject to any disclaimer, the term of this patent is extended or adjusted under 35 U.S.C. 154(b) by 0 days.

(21) Appl. No.: 14/284,352

(22) Filed: May 21, 2014

(65) Prior Publication Data

US 2014/0345165 A1 Nov. 27, 2014

Related U.S. Application Data

(60) Provisional application No. 61/825,889, filed on May 21, 2013.

(51) Int. Cl.
*A43B 3/02* (2006.01)
*A43B 9/06* (2006.01)
(Continued)

(52) U.S. Cl.
CPC ... *A43B 3/02* (2013.01); *A43B 9/06* (2013.01); *A43B 23/022* (2013.01); *A43B 23/0295* (2013.01); *A43B 23/06* (2013.01)

(58) Field of Classification Search
CPC ..... A43B 7/12; A43B 3/02; A43B 3/00; A43B 3/04; A43B 9/00; A43B 13/14; A43B 23/0245
USPC ..... 36/1.5, 2 R, 83, 84, 109, 99, 12, 17 R
See application file for complete search history.

(56) References Cited

U.S. PATENT DOCUMENTS

D10,959 S 12/1878 Kenz et al.
573,664 A * 12/1896 Kinsley ..... 36/4
(Continued)

FOREIGN PATENT DOCUMENTS

EP 2319245 A1 5/2011
EP 2319345 A1 5/2011
(Continued)

OTHER PUBLICATIONS

International Search Report and Written Opinion mailed Oct. 10, 2014, from PCT Application No. PCT/US2014/039006 (10 pages).
(Continued)

*Primary Examiner* — Jila M Mohandesi
(74) *Attorney, Agent, or Firm* — DASCENZO Intellectual Property Law, P.C.

(57) ABSTRACT

Boots having an appearance indicative of a particular style or construction can be constructed with portions of the boot that have an appearance and characteristics directed toward functionality other than appearance or style. Portions of a boot that are not generally visible when worn, for example, with pants or coveralls, include the shaft or chimney of the upper portion of the boot. The shaft of such boots can be constructed of materials that are generally waterproof or fluid-resistant, making the boot easier to clean and mitigating against dirt, mud, or other soiling factors from adhering to such portions of the boot. In combination with a generally visible portion of the boot, such as the vamp and toe box, having an indicative appearance, such boots allow for a wearer to both present footwear having a particular style and fluid-resistant or waterproof characteristics.

25 Claims, 9 Drawing Sheets

(51) Int. Cl.
*A43B 23/02* (2006.01)
*A43B 23/06* (2006.01)

(56) References Cited

U.S. PATENT DOCUMENTS

| | | | | |
|---|---|---|---|---|
| 2,306,306 | A * | 12/1942 | Ferrettie | 36/4 |
| D236,665 | S | 9/1975 | Massacré | |
| D238,910 | S | 2/1976 | Persson et al. | |
| 4,016,661 | A | 4/1977 | Tibbitts | |
| D303,037 | S | 8/1989 | Kushitani | |
| D369,894 | S | 5/1996 | Stolberg | |
| D380,592 | S | 7/1997 | Whittington | |
| 5,943,793 | A | 8/1999 | Clements | |
| 7,730,640 | B2 | 6/2010 | Clark et al. | |
| 7,891,116 | B1 * | 2/2011 | Iglikov | 36/4 |
| 7,913,427 | B2 | 3/2011 | Edwards et al. | |
| D638,213 | S | 5/2011 | Funck | |
| 7,980,010 | B2 | 7/2011 | Davis et al. | |
| 8,336,229 | B2 | 12/2012 | La Rochelle | |
| 8,361,369 | B1 * | 1/2013 | Cook et al. | 264/244 |
| 2004/0020077 | A1 * | 2/2004 | Thomas et al. | 36/4 |
| 2006/0185192 | A1 | 8/2006 | Biancucci | |
| 2009/0025252 | A1 * | 1/2009 | O'Connor et al. | 36/4 |
| 2010/0031534 | A1 * | 2/2010 | Davis et al. | 36/102 |
| 2010/0064551 | A1 | 3/2010 | Aldridge | |
| 2010/0126044 | A1 | 5/2010 | Davis | |
| 2010/0180474 | A1 * | 7/2010 | Clark et al. | 36/3 B |
| 2011/0078924 | A1 | 4/2011 | Rackiewicz et al. | |
| 2011/0271553 | A1 | 11/2011 | McCarron | |
| 2013/0047473 | A1 | 2/2013 | Jessiman et al. | |
| 2013/0133229 | A1 | 5/2013 | Ludemann et al. | |
| 2014/0090275 | A1 | 4/2014 | Rackiewicz et al. | |

FOREIGN PATENT DOCUMENTS

| | | | |
|---|---|---|---|
| WO | 00/70979 | A1 | 11/2000 |
| WO | WO 2004/039197 | A1 | 5/2004 |

OTHER PUBLICATIONS

Women's 9 Inch Wellington Tan and Camo Boot. Catalog [online]. Deere & Company. Apr. 5, 2013 [retrieved on Sep. 4, 2014]. Retrieved from the internet: <URL: https://web.archive.org/web/20130405042947/http://www.johndeeregifts.com/product/womens/boots/women%27s+9%22+wellington+boot+in+tan+and+camo+.do>.

John Deere Children's Mossy Oak Waterproof Pull on Boot. Catalog [online]. Deere & Company. Apr. 5, 2013 [retrieved on Sep. 4, 2014]. Retrieved from the internet: <URL: https://web.archive.org/web/20130405003900/http://www.johndeeregifts.com/product/kids/childrens+boots/children%027s+john+deere+mossy+oak+waterproof+pull+on.do#>.

* cited by examiner

HYBRID BOOTS

CROSS-REFERENCES TO RELATED APPLICATIONS

The present application claims priority to U.S. provisional patent application 61/825,889, filed on May 21, 2013, which is hereby incorporated by reference.

FIELD OF THE INVENTION

The present disclosure relates to boots, and more particularly to boots that include a combination of conventional leather/welted components as well as synthetic components.

BACKGROUND OF THE INVENTION

Many types of boot, including work boots, hiking boots, riding equestrian) boots, motorcycle boots, Western (cowboy) boots, and other specialty boots are worn for a variety of applications. Historically, riding boots and Western boots have been constructed with leather uppers, including leather shells and leather shafts. Western boots in particular, over the years, have incorporated design elements in the shell that rely on a leather construction. Moreover, Western boots typically utilize a traditional welted construction with visible stitching. Accordingly, Western boots have a certain appearance that wearers of Western boots rely on and expect to be visible when worn.

Many types of boots, further require functional characteristics, such as fluid-resistant, soil-resistant, and/or waterproof characteristics not found in traditional boots that have a particular design. There continues to be a need for boots that address both functional and aesthetic needs of wearers.

BRIEF SUMMARY OF THE INVENTION

Boots having an appearance indicative of a particular style or construction can be constructed with portions of the boot that have an appearance and characteristics directed toward functionality other than appearance or style. Portions of a boot that are not generally visible when worn, for example, with pants or coveralls, include the shaft or chimney of the upper portion of the boot. The shaft of such boots can be constructed of materials that are generally waterproof or fluid-resistant, making the boot easier to clean and mitigating against dirt, mud, or other soiling factors from adhering to such portions of the boot. In combination with a generally visible portion of the boot, such as the vamp and toe box, having an indicative appearance, such boots allow for a wearer to both present footwear having a particular style and fluid-resistant or waterproof characteristics.

In some embodiments, the present disclosure is directed to a boot that includes an upper including a shell sized to receive a wearer's foot and a shaft extending above the shell and sized to receive a wearer's lower leg, and a sole assembly operatively coupled to the upper. In such embodiments, the boot can have a sole assembly which includes an insole, an outsole, a heel, and a welt that operatively couples the outsole to the upper. In some aspects, a boot can include a welt that is constructed substantially of leather. In other aspects, a boot can have an outsole constructed substantially of synthetic rubber. In further aspects, the boot heel can be constructed substantially of synthetic rubber. In some aspects, the boot sole assembly has a traditional welted construction. In other aspects, the boot sole assembly has a traditional welted construction with visible stitching.

In other embodiments, a boot as disclosed herein can have a shaft that is constructed substantially of neoprene. In some aspects, a boot can have a shaft which includes lateral side panels that are constructed substantially of neoprene. In other aspects, the boot shaft can further includes a front strip of material extending between and operatively coupling the lateral side panels on a front side of the shaft, and a rear strip of material extending between and operatively coupling the lateral side panels on a rear side of the shaft. In further aspects, the front strip of material is constructed substantially of a vulcanized rubber or polymer. Similarly, in some aspects, the rear strip of material is constructed substantially of a vulcanized rubber or polymer. In other aspects, a boot with a shaft that is constructed substantially of neoprene can have a shell that is constructed substantially of a material other than neoprene.

In some embodiments, the vamp region of a boot can be constructed of at least a first material, the shaft region of a boot can be constructed of at least a second material, and optionally, a transitional section of a boot can be constructed of a third material. In some aspects, the first material can be less soft or pliable than either or both of the second and third materials. In other aspects, the second material can be more soft or pliable than either or both of the first and third materials. In specific aspects, the second material can be neoprene, or the first material can be a material other than neoprene. In further aspects, the first, second, and third materials can have similar or different degrees of fluid-resistance, soil-resistance, or waterproof characteristics. In further aspects, the vamp region of a boot can be constructed of a vamp shell and at least one heel shell, where the vamp shell and at least one heel shell can be made of the same or different material.

In further embodiments, a boot as disclosed herein can have a shell which includes a front shell panel and a rear shell panel. In some aspects, the boot can have a front shell panel and a rear shell panel which are constructed substantially of different materials. In other aspects, the boot can have a front shell panel which is constructed substantially of leather. In further aspects, the boot can have a rear shell panel which is constructed substantially of a thermoplastic urethane. In various aspects, the boot can be a Western boot or a riding boot. In some aspects, the boot shell can incorporate Western boot design elements.

These and other features, aspects, and advantages are described below with reference to the following drawings, and will become better understood when the following detailed description is read with reference to the accompanying drawings.

DETAILED DESCRIPTION OF THE INVENTION

Throughout this description for the purposes of explanation, numerous specific details are set forth in order to provide a thorough understanding of the many embodiments disclosed herein. It will be apparent, however, to one skilled in the art that the many embodiments may be practiced without some of these specific details. In other instances, well-known structures and devices are shown in diagram or schematic form to avoid obscuring the underlying principles of the described embodiments.

Figure 1:
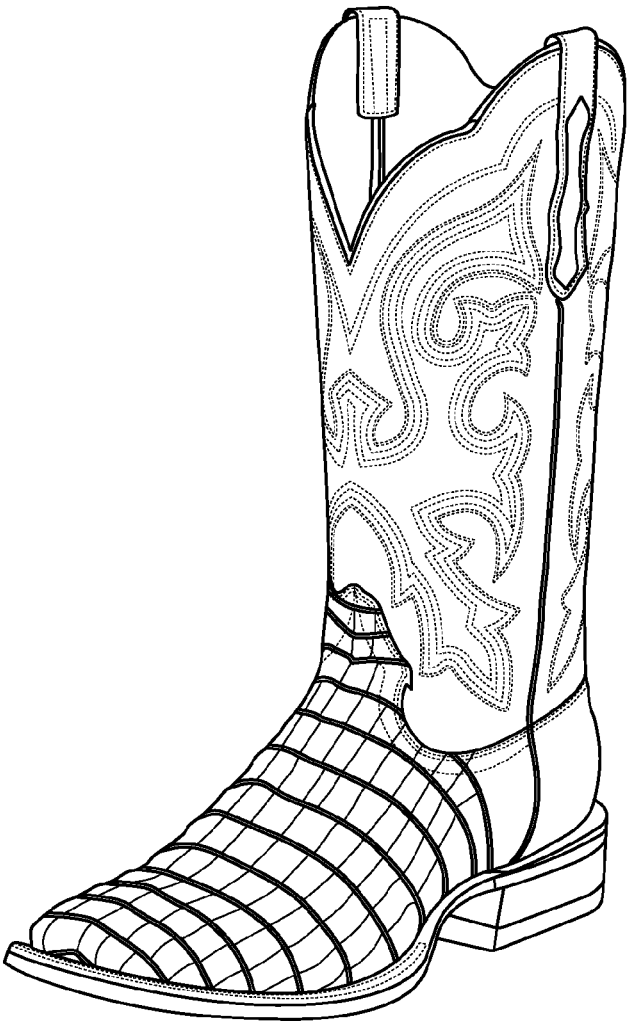
FIG. 1 (PRIOR ART)
FIG. 1 is a perspective view of a boot having a conventional leather/welted construction and a leather upper.
Figure 2:
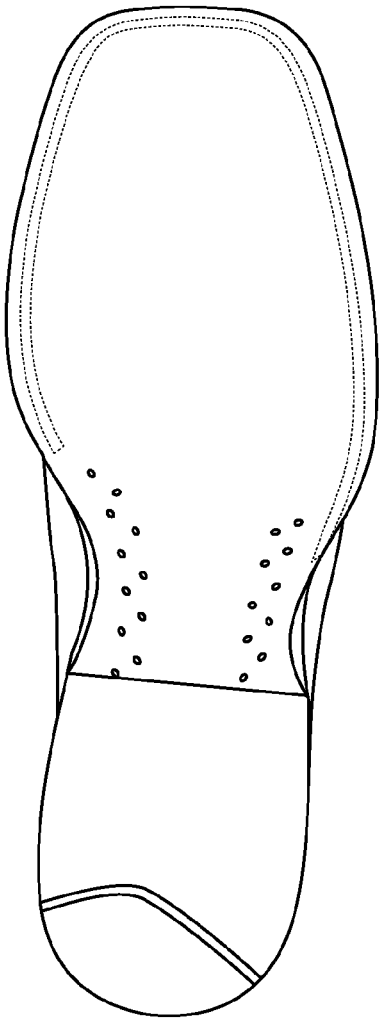
FIG. 2 (PRIOR ART)
FIG. 2 is a bottom view of the sole of the boot of FIG. 1.

Many types of boots are worn for both functional and aesthetic purposes. An illustrative, non-exclusive example of a Western boot having a construction with a particular aesthetic design is shown in FIGS. 1 and 2. Functional characteristics, such as fluid-resistance, soil-resistance, and being waterproof allow for boots to be worn in high-stress work environments but retain an ability to be easily cleaned, while still providing the protective and traction characteristics expected of a boot. Boots having a functionality are further worn for aesthetic purposes, with designs, patterning, materials, and other visible elements to reflect and project a particular style or appearance. Hybrid boots as described in this disclosure can combine both the functional and aesthetic characteristics to be useful to wearers in multiple settings and environments.

Figure 3:
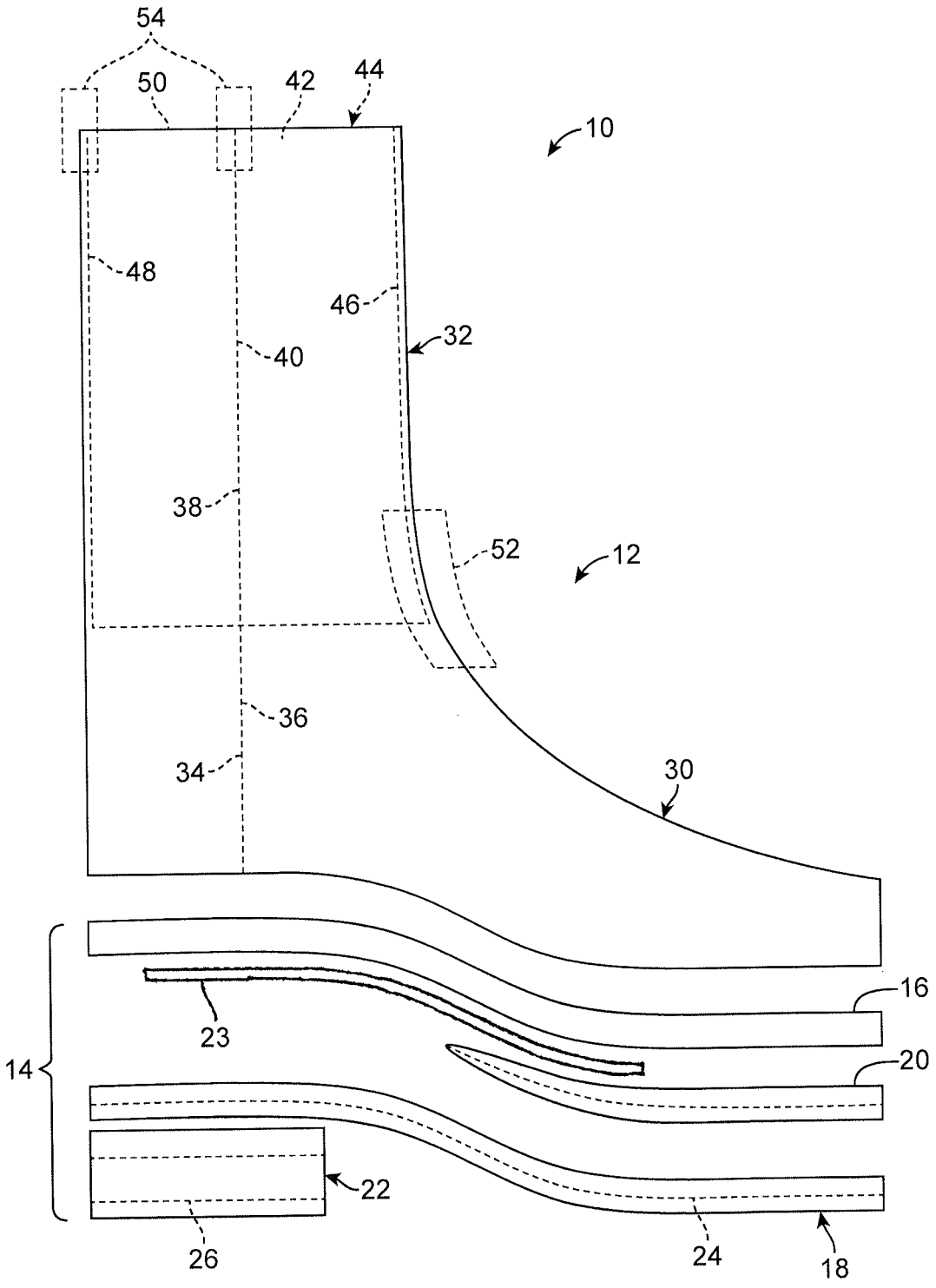
FIG. 3 is an exploded side view diagram schematically representing hybrid boots according to the present disclosure.

FIG. 3 schematically represents boots 10 according to the present disclosure. As discussed in more detail herein, boots 10 according to the present disclosure include a leather sole and/or shell and may include a welted construction to join the upper of the boot to the outsole of the boot. This construction is conventional for Western/cowboy, equestrian, and many other types of boots. However, boots 10 also include an upper that is formed from one or more unconventional materials (at least in the context of these types of boots), such as rubber, neoprene (polychloroprene), plastic, and/or polymeric materials. As such, boots 10 additionally or alternatively may be referred to as hybrid boots 10.

In FIG. 3, elements that are likely to be included in a given a particular) embodiment of a boot 10 are illustrated in solid lines, white elements that are optional to a given embodiment are illustrated in dashed lines. However, elements that are shown in solid lines are not essential to all embodiments, and an element shown in solid lines may be omitted from a particular embodiment without departing from the scope of the present disclosure.

As shown in FIG. 3, boots 10 include an upper 12. That is operatively coupled to a sole assembly 14. The sole assembly 14 includes an insole 16, an outsole 18, a welt 20, and a heel 22. In some embodiments, the sole assembly also includes a rigid shank 23 that is positioned above the outsole and below the insole. In constructing the sole assembly 14, the outsole is secured to the insole by sewing (and/or through the use of an adhesive) the welt between the outsole and the insole. The insole is operatively coupled to the upper, so that with the welting process, the sole assembly is operatively coupled to the upper. As schematically illustrated in FIG. 3 with dashed lines, the insole, the outsole, the welt, and the heel each optionally may include more than one layer of material stacked together to compositely form the respective boot component.

An outsole 18 may be formed from any suitable material or materials. For example, an outsole may be formed entirely from leather, including two or more layers of leather, such as which may be manually stacked together, sized, and sewn (stitched) or adhered together. This process may be referred to as stock fitting the layers of the outsole. While leather outsoles, and especially leather outsoles that are stitched, or sewn, to the insole and/or the welt, provide a classic, traditional style, leather is not as durable as, and may not provide a desired traction as, many composite and/or man-made materials.

Accordingly, in some embodiments of boots 10, an outsole may be entirely formed from rubber or other composite or man-made material having greater friction, or traction, than the smooth leather that is commonly used to form the ground-contacting surface of an outsole of Western boots or riding (equestrian) boots, for example. Alternatively, in some embodiments of boots 10, the outsole may include at least one upper layer of leather and at least one lower layer 24 of rubber or other composite or man-made material and that optionally includes, or defines, tread structures that are configured to provide enhanced traction to the ground-contacting surface of the outsole. Examples of materials other than leather that may be utilized to construct outsoles, including optional lower layers 24 thereof, include (but are not limited to) rubbers, polymers, elastomers, polyurethanes, synthetic rubbers, and such injection-moldable polymers as thermo polyurethanes, thermo poly rubbers, and thermo rubbers. It is within the scope of the present disclosure that outsole 18 may be secured to upper 12 by a process that does not include welt 20.

Although illustrated in FIG. 3 as a separate structure, a heel 22 according to the present disclosure, in some embodiments, may be integrally formed with, or otherwise described as a portion of the outsole 18. Additionally or alternatively, as schematically represented in FIG. 3, a heel 22 may include two or more layers of one or more materials that are operatively coupled together, such as by adhesive, by integral forming, by fasteners, such as tacks or nails, etc. In some embodiments, the heel may include at least a lower layer 26 that includes, or defines, tread structures that are configured to provide enhanced traction to the ground-contacting surface of the heel. Illustrative, non-exclusive examples of materials that may be used to construct one or more layers of a heel include those materials set forth above with respect to optional materials used for the outsole 18. Heels 22 also may include one or more layers of leather, wood, or any other suitable materials.

The welt 20 also may be formed from any suitable material or materials, including one or more layers of leather or any one or more of the aforementioned non-leather materials. The welt extends around the outer perimeter of the sole assembly, around the front-most region of the sole assembly, and into the arch region of the sole assembly. Accordingly, the welt provides structure for operative attachment between the upper and the outsole. However, from the arch region to the rear-most region of the sole assembly, the outsole can be coupled directly to the upper with nails, an adhesive, or other such joining elements.

Although not required to all embodiments of boots 10 according to the present disclosure, the assembly of the sole assembly and the operative coupling of the sole assembly to the upper may be described as utilizing traditional footwear assembly techniques, including traditional welt processes, such as a Goodyear welt process. Accordingly, a boot 10 may be described as having a traditional look, with the welt and associated stitching visible when viewing the exterior of a fully assembled boot.

Upper 12 of a boot 10 may be described as including a shell 30 and a shaft 32. Shell 30 is attached to outsole 18 and is sized and shaped to receive and extend around the foot of the wearer when the boot is worn. In slightly different terms, the outsole and shell collectively house the wearer's foot when the boot is worn, with the outsole extending generally beneath the sole of the wearer's foot, and the shell extending generally around the sides and top of the wearer's foot. Shell 30 may be formed from one or more sections, or panels, which as discussed, may be formed from leather or a similar material As used herein, "leather" is intended to include both natural and synthetic hides, skins, and similar materials that have conventionally been used for constructing at least Western, cowboy, and equestrian boots. When shell 30 is formed from two or more panels, or sections, these panels or sections are operatively coupled together to form the shell. As an illustrative, non-exclusive example, as schematically represented in FIG. 3, it is within the scope of the present disclosure that the shell 30 may include a front shell panel 34 and a rear shell panel 36 that are operatively coupled together to define the shell. The sections or panels of the shell may be operatively connected together by stitching or any other suitable method or process for joining at least the end regions of at least one, and often two or more, panel(s) or section(s) together.

Shaft 32, which additionally or alternatively may be referred to as a chimney 32, is attached to the shell and extends upward from the shell. Shaft 32 is sized and shaped to receive and extend around the lower leg of a wearer of the boot. In further aspects, the shaft 32 is sized and shaped to receive and extend around the lower leg of a wearer of the boot, including the leg of the pants or jeans the wearer is wearing. By extending around and covering the leg of the pants or jeans a wearer is wearing with the boot, the shaft 32 of the boot can protect the pants or jean leg from becoming soiled or wet. The shaft 32 can be constructed to fit around both a wearer's leg alone and a wearer's leg including the fabric of pants or jeans while retaining its structure as a shaft 32 in both configurations. The shaft defines an opening 50, through which a wearer extends his/her foot into the upper and subsequently into the shell when the wearer is putting the boot on the wearer's foot.

Although it is within the scope of the present disclosure that shaft 32 may be constructed from a single panel, or section, it is within the scope of the present disclosure that shaft 32 may be constructed from two or more panels, portions, or sections that are operatively coupled together to form the upper, such as by stitching or any other suitable method or process for joining at least the end regions of at least one, and often two or more, panel(s) together some embodiments, although not required to all embodiments, such as schematically and optionally represented by the dashed line separating the shell and the shaft, the shell and the shaft may be formed separately and subsequently and operatively joined together. While stitching and similar processes may be used, such as may be used to join the sections and/or panels of the shell and/or to connect the shell to the shaft, it is within the scope of the present disclosure that any suitable process may be used to join the end regions, panels, and/or sections of the shaft together to form shaft 32. Such panels can be oriented to be the lateral sides forming a shaft, a fore panel and an aft panel forming a shaft, or a combination thereof.

As an illustrative, non-exclusive example, and as schematically represented in FIG. 3, it is within the scope of the present disclosure that shaft 32 may include a front shaft panel 38 and a rear shaft panel 40 that are operatively coupled together to define the shaft. Additionally or alternatively, in some embodiments, shaft 32 of a boot 10 according to the present disclosure may include two lateral side panels 42, 44 (e.g., a left panel and a right panel) that are operatively coupled together. In some such embodiments, the lateral side panels may be coupled together via one or more strips of material, such as a front strip 46 positioned between the lateral side panels generally on the front of the shaft, and/or a rear strip 48 positioned between the lateral side panels generally on the back of the shaft, as schematically and optionally illustrated in FIG. 3. Accordingly, when present, the lateral side panels may not be directly engaged or otherwise joined together, as the front and rear strips may separate the lateral side panels. The front and rear strips additionally or alternatively may be described as front and rear panels or sections of a shaft 32. In alternative examples, the shaft 32, when constructed of a front (or fore) shaft panel 38 and a rear (or aft) shaft panel 40, can coupled together via one or more strips of material on the lateral sides of the shaft 32.

The representation of the various optional panels, including the optional strips 46, 48, of an upper 12. In FIG. 3 is schematic in nature, and the size and shape illustrated are not limiting. For example, the various seams separating two panels are not required to be linear, and the various panels are not required to have regular shapes, linear edges, etc. As an illustrative, non-exclusive example, the perimeters of one or more panels of the upper may incorporate typical design elements and shapes that are often utilized in Western boots and/or riding (equestrian) boots.

The various components of an upper 12 (such as shell 30, shaft 32, and/or the optional panels or sections thereof) of a boot 10 according to the present disclosure may be constructed from any suitable material or materials, and it is within the scope of the present disclosure that different panels of an upper may be constructed from different materials. For example, the shaft may be constructed from different materials than the shell, and/or one panel of a shaft or shell may be constructed from a different material than another panel of the shaft or shell. Additionally, or alternatively, a single panel may be constructed of more than one material, such as with layers or different materials, such as an outer layer and an inner layer, or liner. Additionally, or alternatively, one or more panels may include coatings or other barriers, such as to make a water-resistant (hydrophobic) coating, an abrasion-resistant coating, etc.

Illustrative, non-exclusive examples of materials from which shaft 32 (and optionally shell 30 and/or panels or sections of the shell and/or shaft) may be substantially (or completely) constructed include (but are not limited to) rubber, synthetic rubber, neoprene (polychloroprene), vulcanized rubber and other polymers, thermoplastic urethanes, various suitable fabrics, and various suitable polymers and plastics. By substantially constructed of a material, it is meant that the respective panel may include a primary material, such as that defines a core and/or an outer surface of the panel, but that the panel also may include one or more inner layers, outer layers, liners, and/or coatings, such as a fabric liner that is operatively coupled to the primary material and that forms an inner surface for contact with the wearer's leg, such as a protective coating that forms an outer layer, etc.

As an illustrative, non-exclusive example of a combination of suitable materials that may be used in a boot 10 according to the present disclosure, the front shell panel 34 may be constructed substantially of leather, the rear shell panel 36 may be constructed substantially of a thermoplastic urethane, the lateral side panels 42, 44 of the shaft 32 may be constructed substantially of neoprene, and the front and rear strips 46, 48 may be constructed substantially of a vulcanized rubber or polymer. Other combinations of materials also are within the scope of the present disclosure, and as mentioned, one or more of such panels also may include a liner and/or coating constructed of a different material.

Hybrid boots 10 according to the present disclosure also may include (but are not required to include) such additional components as one or more fastening mechanisms 52, such as laces and/or buckles, for selectively tightening the upper around a wearer's foot and lower leg, and one or more grasping structures 54 configured to permit a wearer to grasp the structure and facilitate pulling the boot onto the wearer's foot. For example, a grasping structure 54 may define a loop that is sized to receive a wearer's finger or fingers so that the wearer may pull the boot onto the wearer's foot.

Additionally or alternatively, boots 10 may include any suitable additional component, including structures disclosed in U.S. Patent Application Publication No. 2010/0126044, U.S. Patent Application Publication No. 2011/0271553, and U.S. Pat. No. 7,980,010, the complete disclosures of which are incorporated herein by reference.

Turning now to FIGS. 4-8, illustrative non-exclusive examples of hybrid boots 10 are illustrated. Where appropriate, the reference numerals from the schematic illustrations of FIG. 3 are used to designate corresponding parts of the embodiments of FIGS. 4-8; however, the examples of FIGS. 4-8 are non-exclusive and do not limit boots 10 to the illustrated embodiments. That is, boots 10 are not limited to the specific embodiments of the illustrated boots of FIGS. 4-8, and boots 10 may incorporate any number of the various aspects, configurations, characteristics, properties, etc. of boots 10 that are illustrated in and discussed with reference to the schematic representations of FIG. 3 and/or the embodiments of FIGS. 4-8, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to the boots 10 of FIGS. 4-8; however, it is within the scope of the present disclosure that the previously discussed features, variants, etc. may be utilized with the illustrated boots of FIGS. 4-8. Moreover, different combinations of the various optional features of boots 10 that are not necessarily utilized in the examples of FIGS. 4-8 may be utilized in other embodiments of boots 10 according to the present disclosure. For example, it is within the scope of the present disclosure that boots 10 may include an outsole and/or shell having the construction and/or materials of the boot shown in FIGS. 1 and/or 2.

Figure 4:
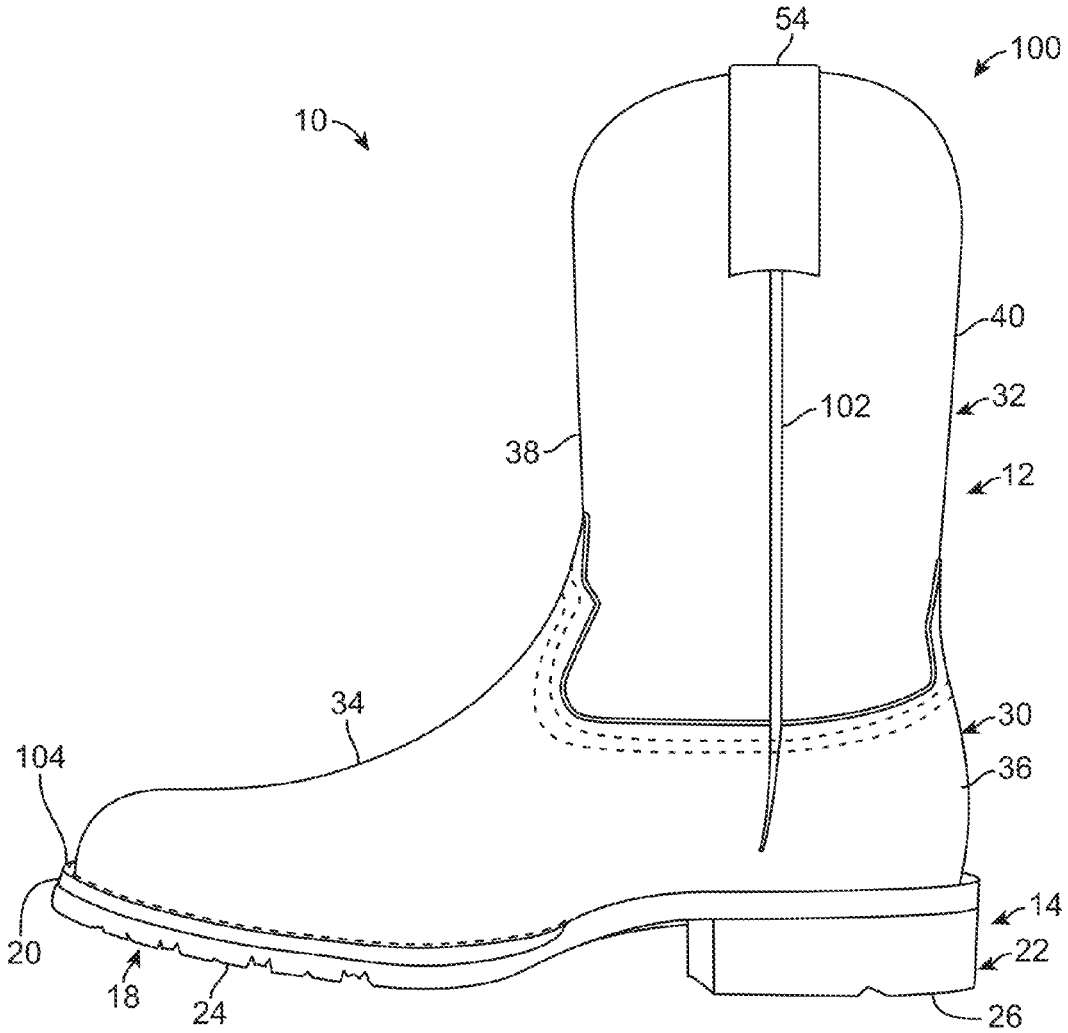
FIG. 4 is side view of an illustrative, non-exclusive example of a hybrid boot according to the present disclosure.
Figure 5:
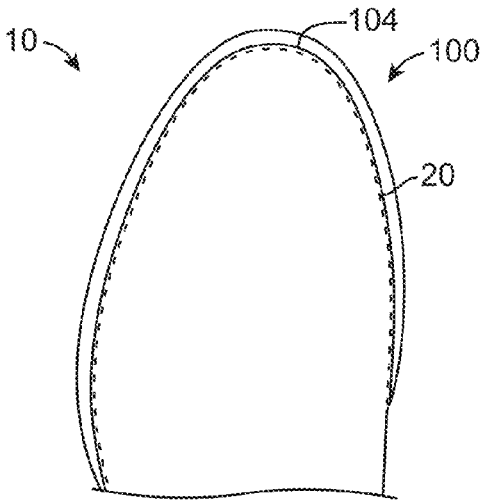
FIG. 5 is a fragmentary top view of the hybrid boot of FIG. 4.
Figure 6:
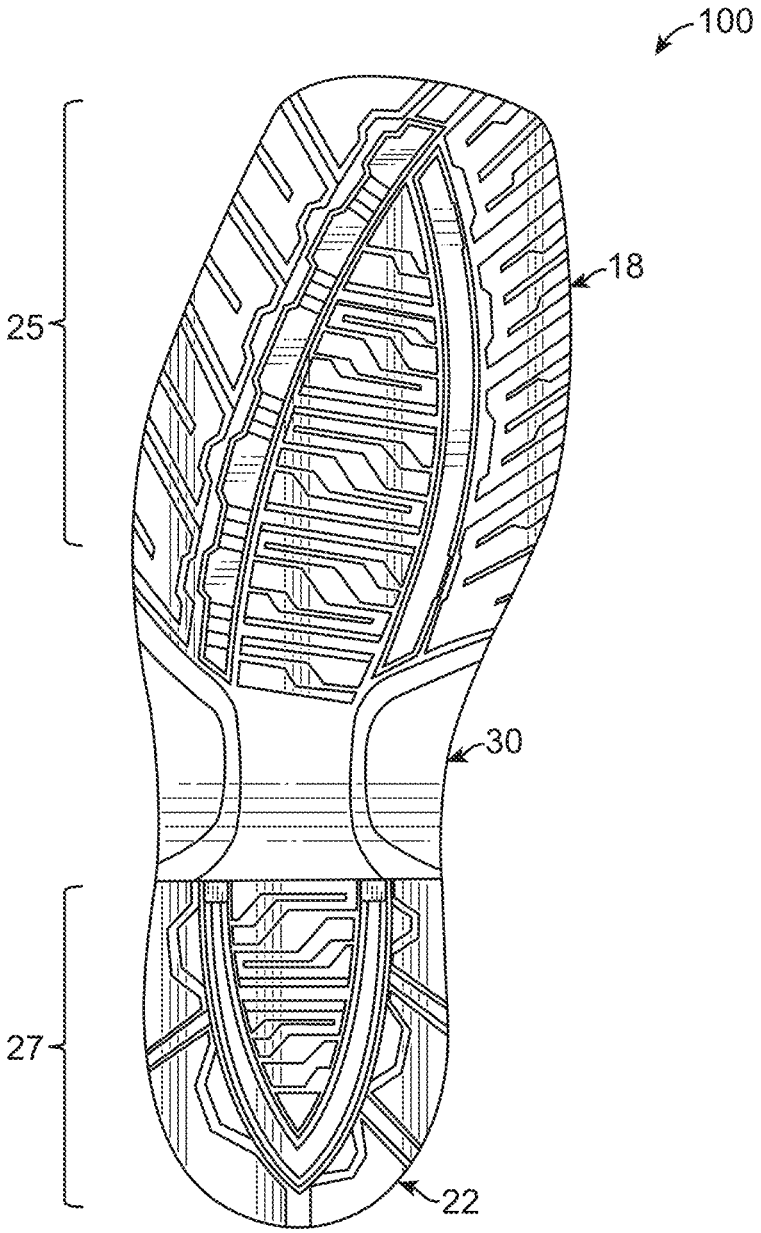
FIG. 6 is a bottom view of the hybrid boot of FIG. 4.

A first illustrative, non-exclusive example of a boot 10 according to the present disclosure is shown in FIGS. 4-6 and indicated generally at 100. Boot 100 is an example of a boot 10 that includes a front shell panel 34 and a rear shell panel 36 that are constructed (at least substantially) of leather. As also shown, outsole 18 is joined to upper 12 with a welting process welt 20. Boot 100 also includes a front shaft panel 38 and a rear shaft panel 40 that are constructed of neoprene or another "unconventional" synthetic, polymeric, plastic, and/or rubber material. As seen in FIG. 4, piping 102 is utilized between and to operatively couple the front and rear panels of the shell and shaft of the upper 12. Moreover, as seen with reference to both FIGS. 4 and 5, boot 100 is an example of a boot 10 that utilizes a leather welt 20 with stitching 104 to operatively couple the outsole 18 to the upper 12. As seen with reference to FIG. 6, the outsole 18 and heel 22 of boot 100 may include tread structures 25, 27, respectively, that define the ground-contacting surfaces of the sole assembly 14. The outsole tread structure 25 and heel tread structure 27 can both be configured to provide enhanced traction to the ground-contacting surface of the outsole 18 and heel 22, respectively. At least a portion of the outsole and/or heel may be formed from a synthetic material, such as which may provide greater traction and/or wear resistance than a traditional leather heel or exterior sole.

Figure 7:
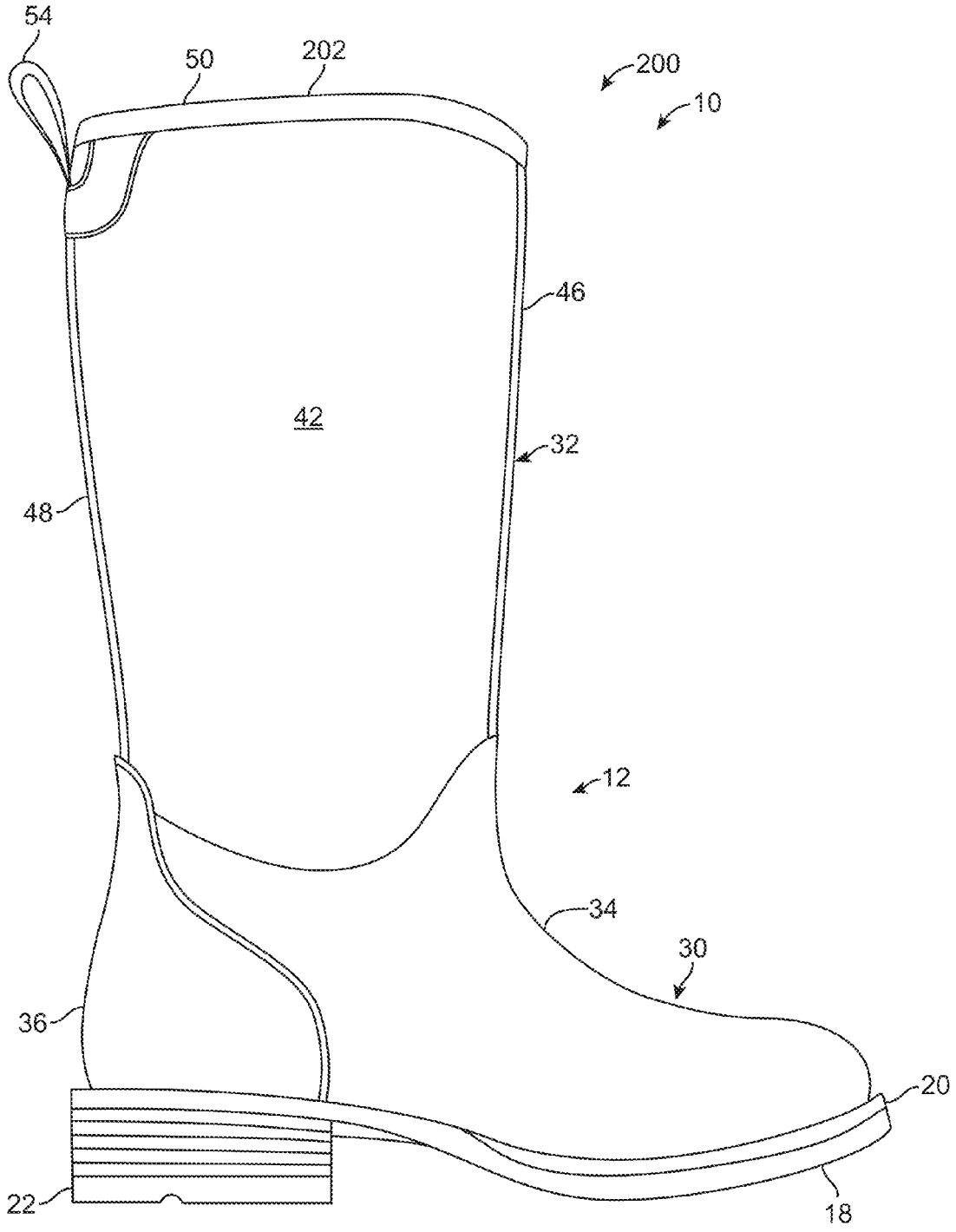
FIG. 7 is a side view of another illustrative, non-exclusive example of a hybrid boot according to the present disclosure.
Figure 8:
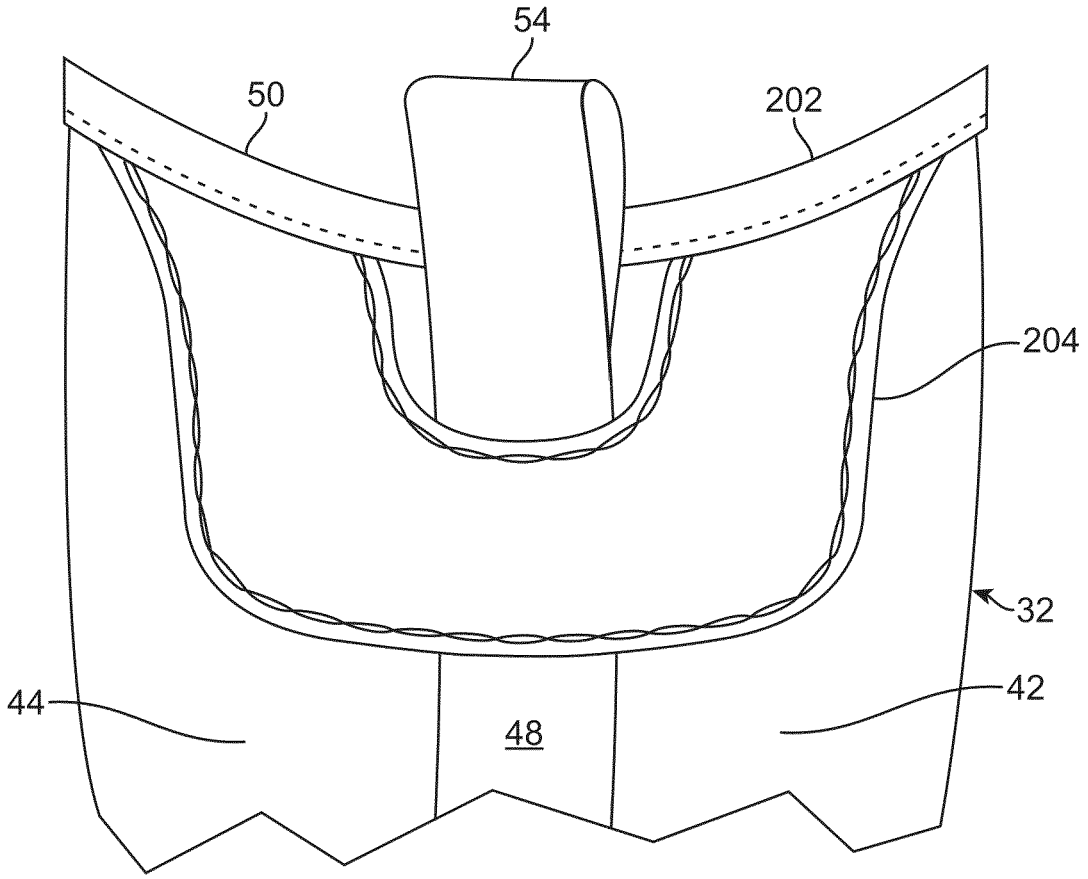
FIG. 8 is a fragmentary rear view of the hybrid boot of FIG. 7.

A second illustrative, non-exclusive example of a boot 10 according to the present disclosure is shown in FIGS. 7 and 8 and indicated generally at 200. Boot 200 is an example of a boot 10 that includes a front shell panel 34 that is constructed substantially of leather, a rear shell panel 36 that is constructed substantially of a thermoplastic urethane, lateral side panels 42, 44 that are constructed substantially of neoprene (or one or more of the other "unconventional" materials that are disclosed herein), and front and rear strips 46, 48 that are constructed substantially of a vulcanized rubber or polymer. Similar to boot 100, boot 200 is an example of a boot 10 that utilizes a leather welt 20 to operatively couple the outsole 18 to the upper 12, and an outsole 18 and heel 22 that are constructed of a synthetic material.

Boot 200 also includes a collar binding, or piping, 202 that finishes the top most edge of the shaft 32 and that defines the opening 50 to the upper, through which a wearer inserts his/her foot. Also, with reference to FIG. 8, boot 200 includes a U-shaped panel 204 that is constructed substantially of a thermoplastic urethane. The rear strip 48 extends in front of panel 204 and forms a grasping structure 54 in the form of a loop that is sized to facilitate a wearer pulling the boot 200 onto the wearer's foot.

Figure 9A:
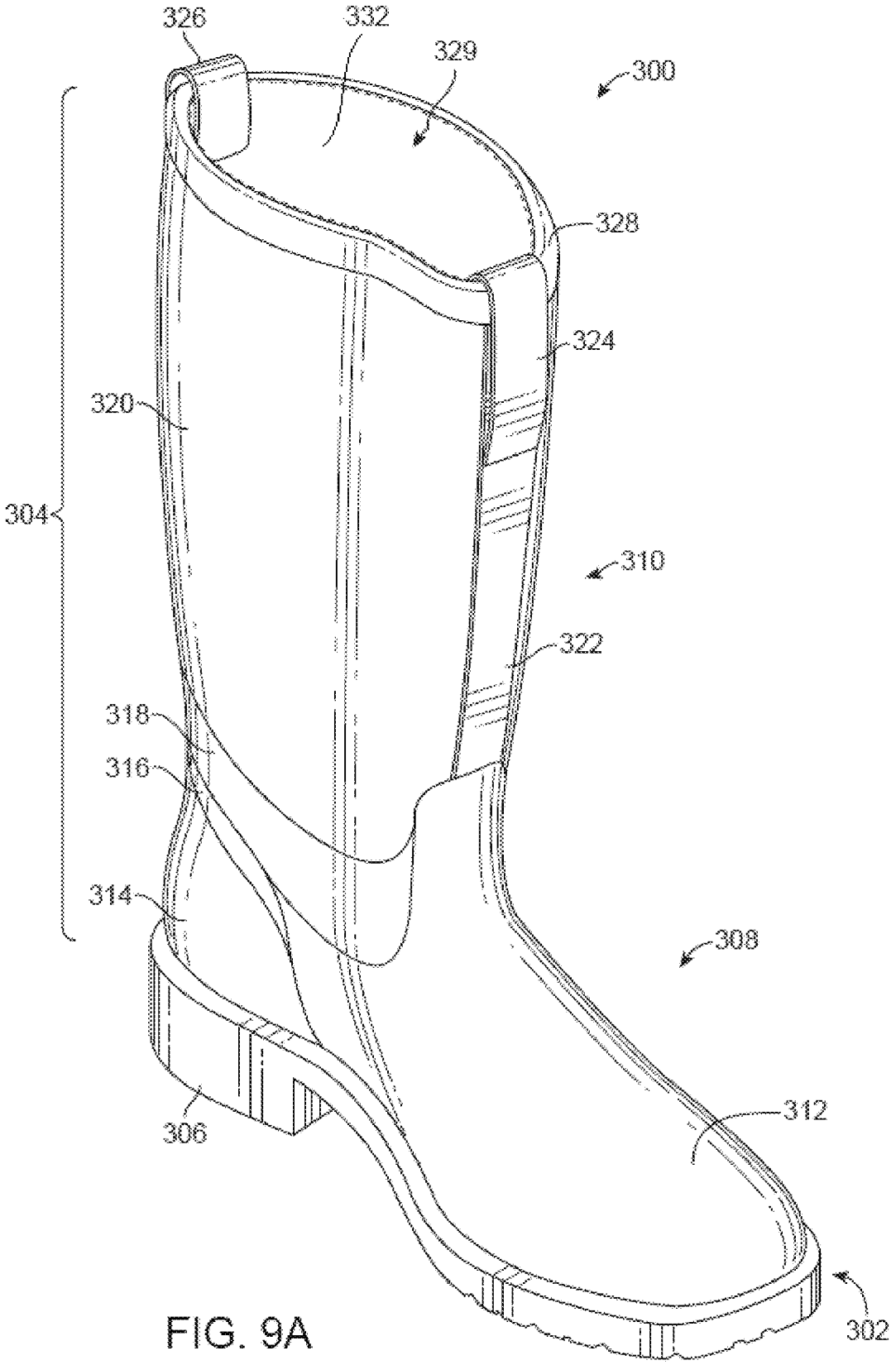
FIG. 9A presents a perspective view of a hybrid boot, according to the present disclosure.

FIG. 9A presents a third illustrative, non-exclusive example of a boot 10 according to the present disclosure, particularly indicated as a hybrid boot 300 presented in a perspective view. The hybrid boot 300 has a sole 302, which in aspects can be a sole assembly which can include an insole, an outsole, welt, a heel 306, and other components used for soles in footwear. The hybrid boot 300 further has an upper 304 attached to the sole 302, where the upper 304 can generally include a vamp region 308 and a shaft region 310 (alternatively referred to as a chimney 310). The vamp region 308 of the hybrid boot 300 generally covers the toe, forefoot, heel, optionally a part of the Achilles region, and optionally a part of the ankle region of a wearer of the hybrid boot 300. The shaft region 310 of the hybrid boot 300 generally covers at least parts of the calf, shin, Achilles region, and optionally a part of the ankle region of a wearer of the hybrid boot 300.

In aspects as illustrated, the vamp region 308 can be constructed of separate sections bound, stitched, or otherwise joined together, including a vamp shell 312, an outer heel shell 314, and an inner heel shell 316. The hybrid boot 300 can further include a transitional section 318 located in between the vamp region 308 and the shaft region 310, which can in part join the vamp region 308 and the shaft region 310 to each other. The components of the vamp region 308 can be formed from leather or a similar material. As used herein, "leather" is intended to include both natural and synthetic hides, skins, and similar materials that have conventionally been used for constructing at least Western, cowboy, and equestrian boots. In various aspects, the vamp shell 312, outer heel shell 314, and inner heel shell 316 can be constructed of the same or different materials, or of materials with the same or different resilience, flexibility, and other structural characteristics. In some aspects, either or both of the outer heel shell 314 and the inner heel shell 316 can include a boot counter not shown) on the interior of the hybrid boot 300.

In some aspects, the inner heel shell 316 and the transitional section 318 are both constructed of separate or split components, and arranged at particular heights or locations along the hybrid boot 300 structure. The arrangement or configuration of the inner heel shell 316 and the transitional section 318 can allow the hybrid boot 300 to retain a particular fit around a wearer's foot or leg, and retain a degree of protection around a wearer's foot or leg. In further aspects, the inner heel shell 314 can be made of a high abrasion material, such as rubber or a rubberized material.

In aspects as illustrated, the shaft region 310 can be constructed of a shaft shell 320, a forestrap 322, a front pullstrap 324, a rear pullstrap 326, and optionally a boot collar 328. In some aspects, the shaft shell 320, forestrap 322, front pullstrap 324, and rear pullstrap 326 can be bound, stitched, or otherwise joined together. In other aspects, the front pullstrap 324 can bound to an interior surface of the hybrid boot 300, extend through an opening 329 at the top of the hybrid boot 300, fold around the boot collar 328 and be bound to the forestrap 322 to form the gripping or pullstrap structure. Similarly, in further aspects, the rear pullstrap 326 can bound to an interior surface of the hybrid boot 300, extend through an opening 329 at the top of the hybrid boot 300, fold around the boot collar 328 and be bound to the an exterior surface of the shaft shell 320 to form the gripping or pullstrap structure. In some aspects, the shaft shell 320 can be constructed of neoprene, a synthetic textile, a natural textile, a plastic, a rubber material, a poly, textile, a cotton textile, a cotton poly, a combination thereof, or even a combination thereof including leather elements. In further aspects, the shaft shell 320, forestrap 322, front pullstrap 324, and rear pullstrap 326 can be constructed of the same materials as the shaft shell 320, and can further be constructed of leather. The material used for the shaft shell 320 can be particularly chosen to have generally fluid-resistant or waterproof characteristics. Such characteristics can include, relative to other materials and components of the hybrid boot 300, but are not limited to: a quicker rate of evaporation of fluids that may soak or saturate the shaft shell 320, a greater degree of fluid beading on the surface of the shaft shell 320, or a greater degree of fluid wicking from the material of the shaft shell 320. In further aspects, the material used to construct of the shaft shell 320 can be relatively more flexible than the material used to construct the vamp region 308 components. In some aspects, the shaft shell 320 can be a single panel in a generally cylindrical shape, where the forestrap 322 is attached to the front of the shaft shell 320. In other aspects, the shaft shell 320 can be constructed of one or more panels stitched, bound, or otherwise joined together to form a generally cylindrical shape, where the forestrap 322 and/or the boot collar 328 can in part bind the panels of the shaft shell together.

In some aspects, a transitional section 318 located in between the vamp region 308 and the shaft region 310, can in part join the vamp region 308 and the shaft region 310 to each other. In other aspects, the vamp region 308 and the shaft region 310 can be directly bound, stitched, or otherwise joined to each other. In further aspects, the vamp region 308 and shaft region 310 can be joined both directly along portions where the vamp region 308 and shaft region 310 interface and also joined using the transitional section 318 as an intermediary region between the vamp region 308 and shaft region 310. The transitional section 318 can be constructed of a material that is the same as either the vamp region 308 or the shaft region 310, or of a material that is different than both the vamp region 308 and the shaft region 310.

In some aspects, the transitional section 318 can be relatively more flexible, soft, or pliable than the materials used for the vamp region 308. In other aspects, the transitional section 318 can be relatively more flexible, soft, or pliable than the materials used for the shaft region 320. In further aspects the materials used for the shaft region 320 can be relatively more flexible, soft, or pliable than either or both of the materials used for the vamp region 308 and the transitional region 318. In some aspects, the vamp region 308 can have (when worn by a wearer) a generally visible surface on which aesthetic designs, patterns, illustrations, or other structures can be presented. In further aspects, the shaft region 310 and/or the transitional section 318 can have a thickness of about 2-7 mm. In particular aspects, the shaft region 310 and/or the transitional section 318 can have a thickness of about 2 mm, about 3 mm, about 4 mm, about 5 mm, about 6 mm, about 7 mm, or a range based on such thicknesses.

Figure 9B:
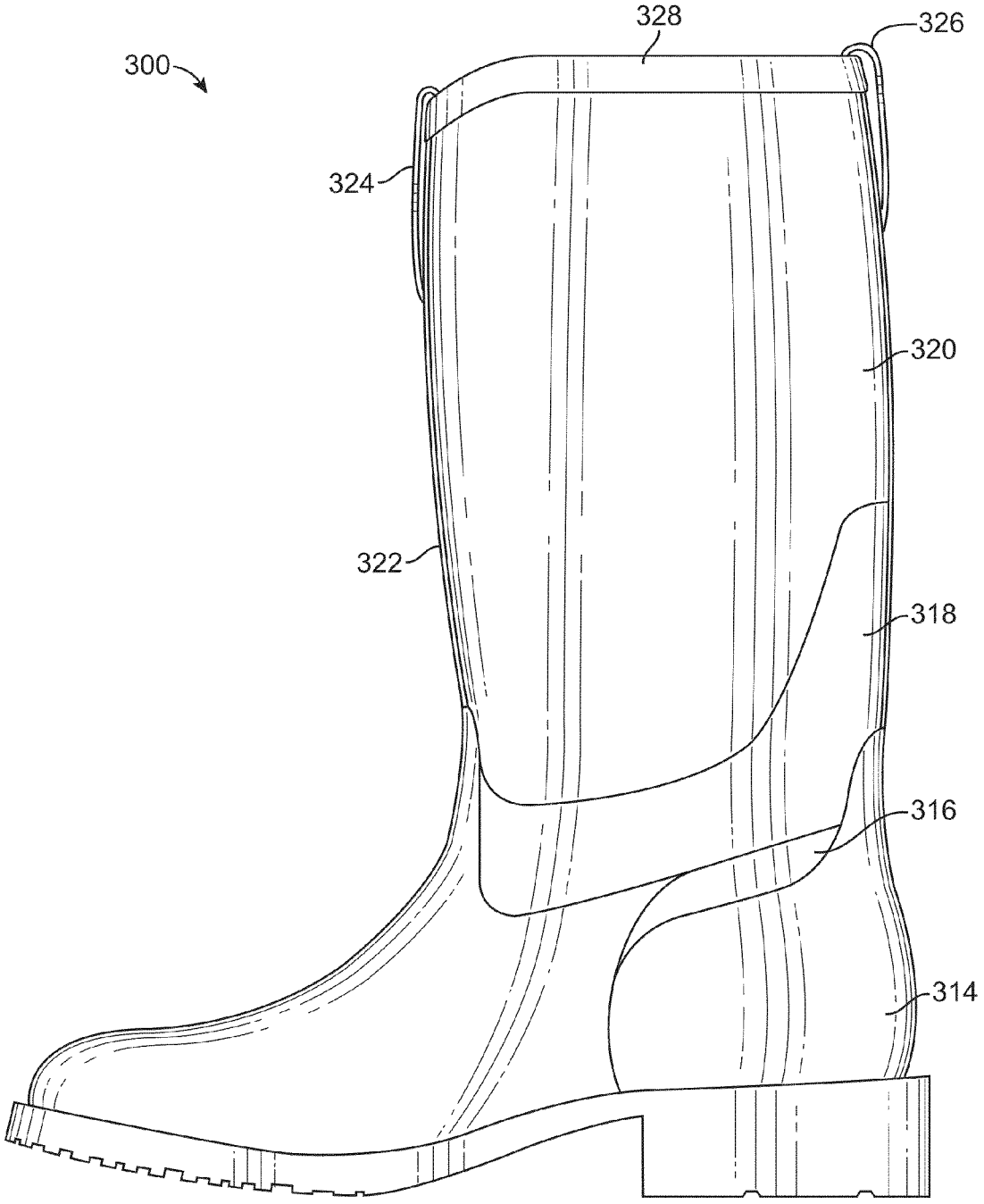
FIG. 9B further illustrates a side elevational view of the hybrid boot of FIG. 9A.

FIG. 9B further illustrates a side elevational view of a hybrid boot 300 as shown in FIG. 9A. As in aspects as shown, the outer heel shell 314 can extend upward along the rear surface of the hybrid boot 300 to generally cover the Achilles region of a wearer, providing protection and support in the Achilles region. Further, in some aspects, the transitional section 318 can extend upward from the outer heel shell 314 and inner heel shell 316 along the rear surface of the hybrid boot 300, particularly along the shaft shell 320, to general cover at least a portion of the calf region of a wearer. In alternative embodiments, the forestrap 322 can extend along the vertical axis of the hybrid boot 300, along the front exterior of the shaft shell 320, and then be secured underneath the boot collar 328 at the top of the hybrid boot 300. The end of the forestrap 322 can be folded forward and secured to a relatively lower portion of the forestrap 322, thereby forming a front pullstrap 324. In further aspects, a rear pullstrap 326 can be located at the top and rear of the hybrid boot 300, similarly being secured underneath the boot collar 328.

Figure 9C:
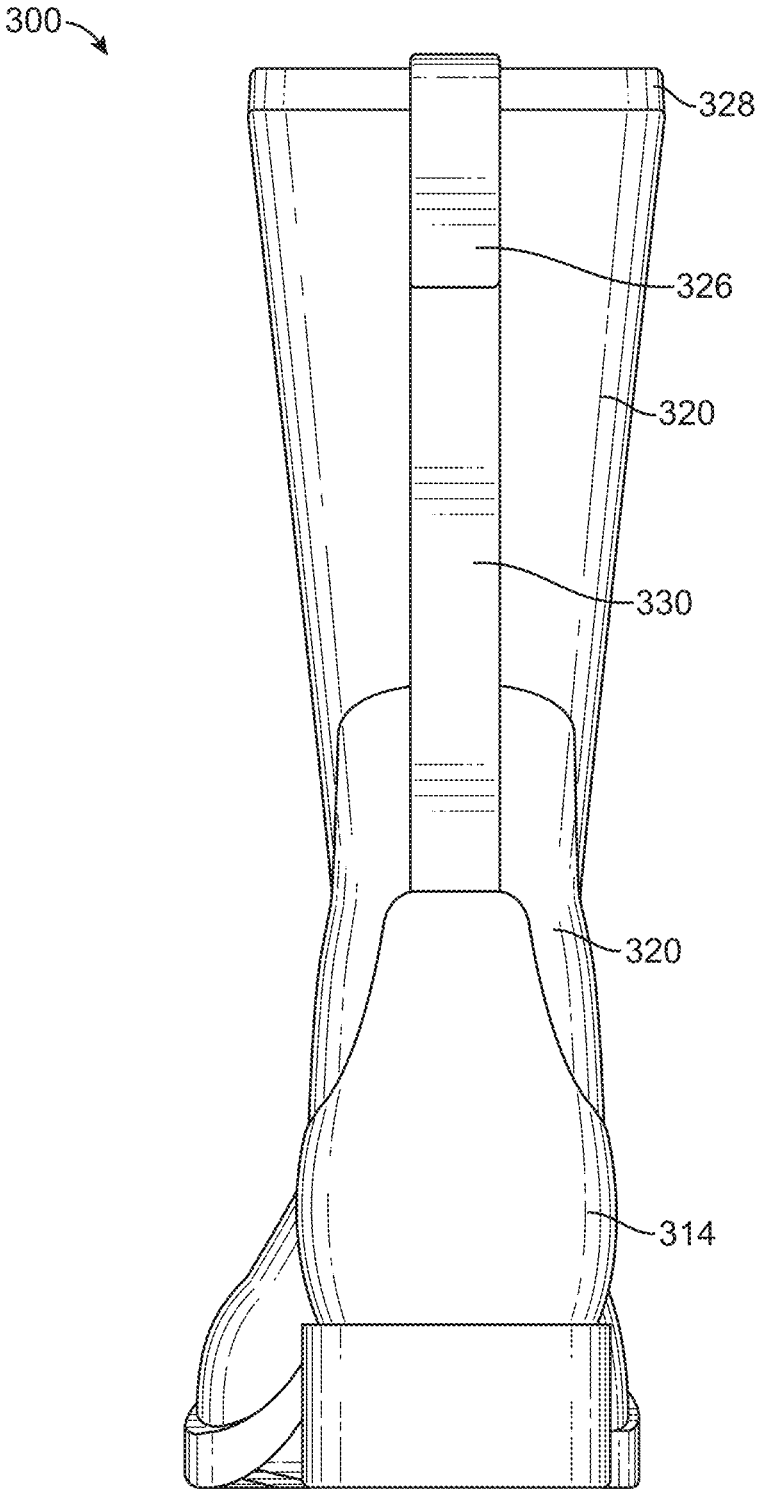
FIG. 9C further illustrates a rear elevational view of the hybrid boot of FIG. 9A.

FIG. 9C further illustrates a rear elevational view of a hybrid boot 300 as shown in FIG. 9A. As in aspects as shown, the outer heel shell 314 can overlap the inner heel shell 316 along the rear surface of the hybrid boot 300, and be directed stitched, bound, or otherwise joined to the transitional section 318. In further aspects, an aftstrap 330 can be connected to the top of the outer heel shell 314 and extend upward along the vertical axis of the rear of the hybrid boot 300. The aftstrap 330 can be stitched, bound, or otherwise joined to the exterior of the transitional section 318 and the shaft shell 320. The rear pullstrap 326 can be bound to and extend from the interior of the hybrid boot and be joined to the aftstrap 330, thereby forming a gripping structure with the rear pullstrap 326.

In some aspects, the hybrid boot 300 can have a lining 332 on the interior of the shaft region 310, which can further extend into the interior of the vamp region 308. The lining 332 can be a waterproof membrane layered in combination with a wicking fabric lining, adhered to the interior of the shaft region 310 and/or the vamp region 308. In other aspects, the lining 332 can include insulating materials, providing the hybrid boot 300 with resistance to the cold for a wearer when the boot is worn.

As used herein, the term "and/or" placed between a first entity and a second entity means one of (1) the first entity, (2) the second entity, and (3) the first entity and the second entity. Multiple entities listed with "and/or" should be construed in the same mariner, i.e., "one or more" of the entities so conjoined. Other entities may optionally be present other than the entities specifically identified by the "and/or" clause, whether related or unrelated to those entities specifically identified. Thus, as a nonlimiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one. A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C" "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, when the disclosure, the preceding numbered paragraphs, or subsequently filed claims recite "a" or "a first" element or the equivalent thereof, such claims should be understood to include incorporation of one or more such elements, neither requiring nor excluding two or more such elements.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A boot, comprising:

a sole assembly, comprising:

a sole having a rear-most region, a front-most region, and an arch region between the rear-most region and the front-most region;

a heel coupled to a bottom surface of the rear-most region of the sole; and a welt; wherein the sole assembly has a traditional welted construction in which the welt and welt stitching are externally exposed and visible and in which the welt is substantially constructed of leather;

an upper comprising a shell and a shaft; wherein the shell is coupled to the sole and includes a front shell section that covers a wearer's toes and a top portion of the wearer's foot when the boot is worn, and a rear shell section that extends around a rear portion of the wearer's foot when the boot is worn; wherein the front shell section is free of fastening mechanisms for selectively tightening the shell around the wearer's foot when the boot is worn; wherein the shaft is located above the shell and extends around the wearer's lower leg when the boot is worn, and further wherein the welt couples at least a portion of the arch region and the front-most region of the sole to the shell;

wherein the front shell section has an outer surface that is substantially constructed of a first material; wherein the first material is leather; and wherein the shaft has an outer surface that is substantially constructed of a second material that is different than the first material; wherein the second material is a water-resistant material that is selected from the group consisting of neoprene, rubber, natural rubber, vulcanized rubber, synthetic rubber, thermoplastic urethane, and combinations thereof.

2. The boot according to claim 1, further comprising a transitional section with an outer surface; wherein the transitional section is coupled to the outer surface of the front shell section and the outer surface of the shaft, wherein the outer surface of the transitional section is constructed of a third material that is different than the first material and the second material.

3. The boot according to claim 1, wherein the first material is a natural leather or hide, a synthetic leather, or a combination thereof.

4. The boot according to claim 1, wherein the second material is neoprene.

5. The boot according to claim 1, wherein the shaft includes lateral side panels that are substantially constructed of neoprene.

6. The boot according to claim 5, wherein the shaft further includes a front strip or forestrap of material extending between and operatively coupling the lateral side panels on a front side of the shaft and a rear strip or aftstrap of material extending between and operatively coupling the lateral side panels on a rear side of the shaft.

7. The boot according to claim 6, wherein the front strip or forestrap of material is substantially constructed of a vulcanized rubber, leather, or polymer.

8. The boot according to claim 6, wherein the rear strip or aftstrap of material is substantially constructed of a vulcanized rubber, leather, or polymer.

9. The boot according to claim 1, wherein the shaft includes a fore panel and an aft panel that are substantially constructed of neoprene.

10. The boot according to claim 9, wherein the shaft further includes strips of material extending between and operatively coupling the fore panel and the at panel.

11. The boot according to claim 10, wherein the strips are substantially constructed of a vulcanized rubber, leather, or polymer.

12. The boot according to claim 1, wherein the shell is substantially constructed of a material other than neoprene.

13. The boot according to claim 12, wherein the rear shell section includes an outer surface that is substantially constructed of leather.

14. The boot according to claim 12, wherein the front shell section and the rear shell section are substantially constructed of different materials.

15. The boot according to claim 14, wherein the rear shell section includes an outer surface that is substantially constructed of a thermoplastic urethane.

16. The boot according to claim 1, wherein the boot is a cowboy boot.

17. The boot according to claim 1, wherein the boot is a riding boot.

18. The boot according to claim 1, wherein the shaft is about 2-7 mm thick.

19. The boot according to claim 1, further comprising a waterproof liner at least partially in the shaft.

20. The boot according to claim 1, further comprising an insulating liner at least partially in the shaft.

21. The boot according to claim 19, wherein the waterproof liner further extends into the shell of the upper.

22. The boot according to claim 20, wherein the insulating liner further extends into the shell of the upper.

23. The boot according to claim 2, wherein the third material is more flexible than the first material and the second material.

24. The boot according to claim 1, wherein the boot is free of fastening mechanisms for selectively tightening the upper around the wearer's lower leg.

25. The boot according to claim 1, wherein the sole includes leather.

* * * * *

UNITED STATES PATENT AND TRADEMARK OFFICE

CERTIFICATE OF CORRECTION

PATENT NO. : 9,204,681 B2
APPLICATION NO. : 14/284352
DATED : December 8, 2015
INVENTOR(S) : John Hollin Kelse Norwood, Marco Aurelio Grott and Austin C. F. Condit It is certified that error appears in the above-identified patent and that said Letters Patent is hereby corrected as shown below:

In the Claims:

Column 13, line 18, after "coupling the fore panel and the" delete "at" and insert --aft--.

Signed and Sealed this
Sixteenth Day of February, 2016

Michelle K. Lee

Michelle K. Lee
*Director of the United States Patent and Trademark Office*